United States Patent [19]

Hamilton

[11] 4,197,981

[45] Apr. 15, 1980

[54] SELF-LOCKING, RECLOSABLE CARTON

[75] Inventor: Gordon A. Hamilton, Highland Springs, Va.

[73] Assignee: Champion International Corporation, Stamford, Conn.

[21] Appl. No.: 939,841

[22] Filed: Sep. 5, 1978

[51] Int. Cl.[2] ..... B65D 5/30

[52] U.S. Cl. ..... 229/36

[58] Field of Search ..... 229/33, 36, 52 B

[56] References Cited

U.S. PATENT DOCUMENTS

| | | | |
|---|---|---|---|
| 504,824 | 9/1893 | Cook | 229/36 |
| 1,509,383 | 9/1924 | Walter | 229/33 |
| 1,600,260 | 9/1926 | Walter | 229/36 |
| 1,616,014 | 2/1927 | Walter | 229/33 |
| 2,077,694 | 4/1937 | Hinton | 229/33 |
| 2,095,764 | 10/1937 | Rueckert | 229/33 |
| 2,367,008 | 1/1945 | Davidson | 229/33 UX |
| 2,572,159 | 10/1951 | Kells et al. | 229/33 X |
| 2,648,484 | 8/1953 | Beisinger | 229/52 B X |
| 2,698,126 | 12/1954 | Beisinger | 229/52 B X |

*Primary Examiner*—Davis T. Moorhead

*Attorney, Agent, or Firm*—Evelyn M. Sommer

[57] ABSTRACT

A self-locking, reclosable carton includes a rectangular floor panel and rectangular side wall panels extending vertically from opposite side edges of the floor panel. Each of the side wall panels includes two inner edge panels which are folded inwardly at the ends of the floor panel. The floor panel has outer end panels which are locked in slightly spaced relationship to the inner end panels by means of tab members which can be forced through narrow openings at the edges of the inner end panels. A cover assembly inclues cover panels extending inwardly from the upper edges of the side wall panels. Each of the cover panels includes cover flaps at the ends which can be inserted into the space between the outer end panel and the inner end panels and held there by frictional engagement to keep the carton closed.

2 Claims, 5 Drawing Figures

SELF-LOCKING, RECLOSABLE CARTON

BACKGROUND OF THE INVENTION

The present invention relates to cartons and more particularly to a self-locking, reclosable carton preferably made froma one piece blank of containerboard or other suitable material.

One or two piece containerboard cartons are used to ship and store many different products, including prewrapped frozen sandwiches and fresh produce. Where products such as those described above are involved, there is no sanitary reason why a carton cannot be reused since the products are either sealed before they are loaded into the carton or are washed as a matter of routine after they are removed from the carton. However, prior art cartons have not been designed with reusability in mind. Prior art two piece cartons generally include a lid which, when once removed, becomes torn or crushed making it unsuitable for reuse. One piece cartons have generally been provided with a sealed top which is removed using a sharp knife. Of course, once the top of the carton is cut off, the carton cannot be reused.

Moreover, known prior art cartons have generally been simple rectangular boxes desired stacking strength. Finally, when one piece cartons are employed, the carton is generally not suitable for continued storage once it has been opened since the remaining contents are no longer adequately protected.

SUMMARY OF THE INVENTION

It is desirable to provide a carton which can be reused, which has good stacking strength and which serves to protect the contents even after it is initially opened.

The present invention is a self-locking, reclosable carton which meets each of these objectives. The carton includes a generally rectangular floor panel and first and second generally rectangular side wall panels which extend upwardly from opposite side edges of the floor panel. The carton has two end wall assemblies, each of which includes a generally rectangular outer panel extending upwardly from an end edge of the floor panel. Each outer end panel is secured in slightly spaced relation to the ends of the side wall panels. A cover assembly includes at least one generally rectangular cover panel connected to the upper edge of one of the side wall panels. The cover panel has end flaps which extend downwardly in overlapping relation to the outer end panels. To reclose the carton once it has been opened, these end flaps are tucked within the outer and panels where they are retained by frictional engagement.

DESCRIPTION OF THE DRAWINGS

While the specification concludes with claims particularly pointing out and distinctly claiming that which is regarded as the present invention, details of a preferrred embodiment of the invention may be more readily ascertained from the following detailed description when read in conjunction with the accompanying drawings wherein:

DETAILED DESCRIPTION

Figure 1:
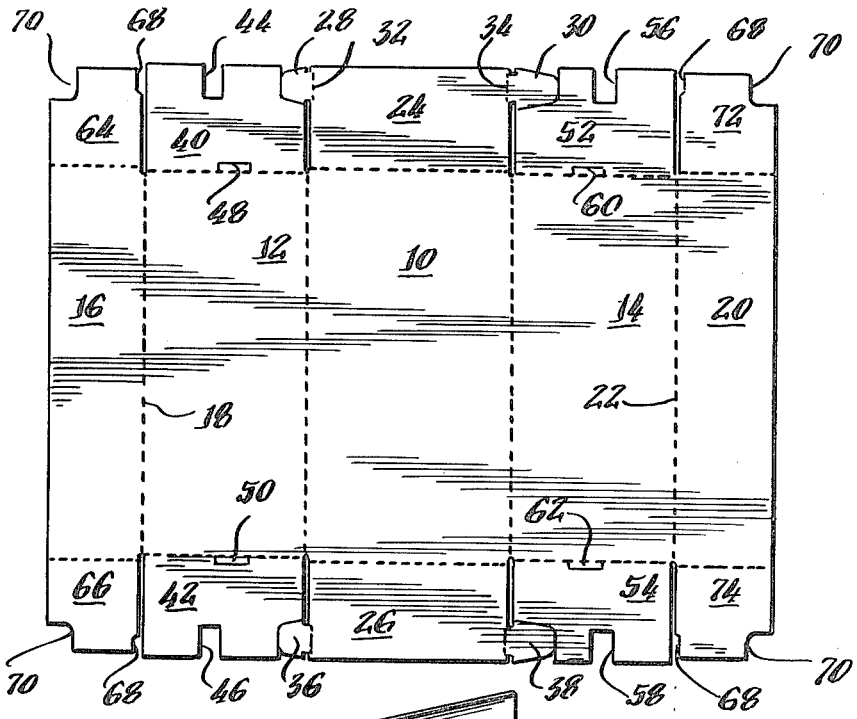
FIG. 1 is a plan view of a one piece blank made in accordance with the present invention.

Referring to FIG. 1, a preferred embodiment of a one-piece blank includes a generally rectangular floor panel 10 flanked by side wall panels 12 and 14. The boundaries between the panels are defined by parallel fold lines. Each of the side wall panels supports part of a cover structure for the carton. More specifically, a cover panel 16 extends from the outer edge 18 of panel 12. A similar cover panel 20 extends from the outer edge 22 of side wall panel 14. Each of the cover panels 16 and 20 has a width substantially equal to one-half of the width of the floor panel 10.

The end wall structures for an erected carton are formed by panels and flaps extending from opposite end edges of the panels 10, 12, 14, 16, and 20. Floor panel 10 carries outer end panels 24 and 26 which are generally rectangular in nature but which include locking means in the form of tab members extending from opposite side edges of each of the outer end panels. For example, outer end panel 24 includes a first tab member 28 extending from its left edge and a second tab member 30 extending from its right edge. In a preferred embodiment, both of the tab members 28 and 30 are generally arrowhead-shaped and are foldably connected to the panel 24 at fold lines 32 and 34, respectively, which parallel the side edges of the end panel 14. Also, in a preferrred embodiment, tab member 30 is larger than tab member 28.

The outer end panel 26 includes tab members 36 and 38 which are preferably identical to tab members 28 and 39, respectively.

Inner end panels for the carton extend from opposite end edges of the side wall panels 12 and 14. More specifically, inner end panels 40 and 42 extend from the opposite end edges of side wall panel 12. The inner end panels 40 and 42 include rectangular notches 44 and 46, respectively, extending into the panels from the outer edges and tabs 48 and 50 formed by generally c-chaped cuts through the carton material at the fold lines between the inner end panels 40 and 42 and the side wall panel 12.

The side wall panel 14 carries similar inner end panesl 52 and 54 having rectangular notches 56 and 58, respectively and tabs 60 and 62 respectively at the boundary with side wall panel 14.

The cover panels 16 and 20 carry cover flaps at opposite end edges. More particularly, cover panel 16 includes first and second cover flaps 64 and 66 at its opposite end edges. Each of the cover flaps includes a small notch 68 at one corner and a larger curved recess 70 at the opposite outside corner.

Cover panel 20 similarly includes cover flaps 72 and 74 with rectangular notches and curved recesses at the inside and outside corners, respectively.

It can be seen that the blank is symmetrical about both vertical and horizontal lines drawn through the center of floor panel 10.

Figure 2:
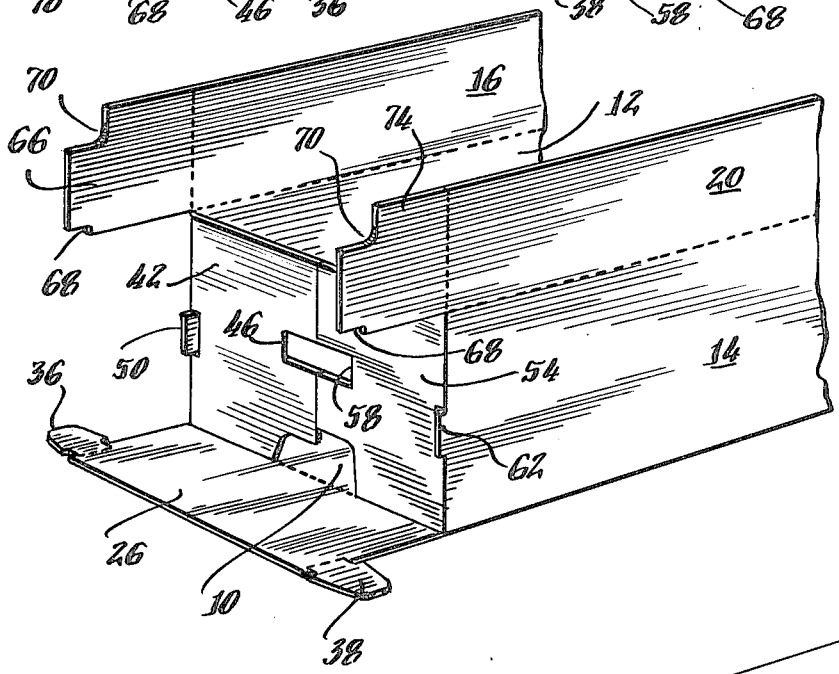
FIG. 2 is a partial perspective view showing a partially erected carton made from the blank of FIG. 1.

Referring to FIG. 2, a self-locking, reclosable carton is erected from the above-described blank by folding the side wall panels 12 and 14 perpendicular to the floor panel 10. The inner end panels 42 and 54 are folded inwardly or toward one another. The same step is taken for the inner end panels 40 and 52, neither of which is shown in FIG. 2. It can be assumed that any action taken at one end of the carton will also be taken at the other end of the carton. Once the inner end panels 42 and 54 are folded perpendicular to the side wall panels 12 and 14, the tab members 36 and 38 are bent upwardly about the fold lines at which they are connected to outer end panel 26. The tab members 36 and 38 are then guided through the narrow openings formed adjacent to tabs 50 and 62, respectively, when the inner end panels are folded perpendicular to the side wall panels. As indicated earlier, tab 38 is preferably longer than tab 36 and can be guided into the opening adjacent tab 62 well before the end of the tab member 36 reaches the opening adjacent tab 50. Making one tab member larger than the other has the advantage that only one tab member at a time has to be guided into place in the narrow openings, making the carton easier to erect. When the tab members 36 and 38 have been forced through the narrow openings in the inner end panels, the carton is locked into shape. The arrowhead-shaped tab members cannot be readily disengaged and thus provide a securely locked carton.

Figure 3:
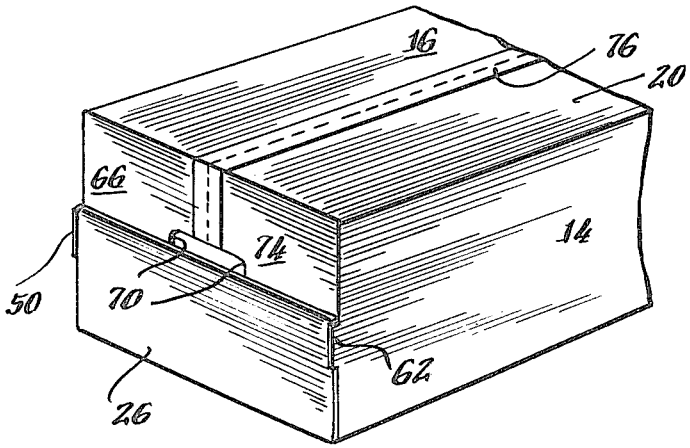
FIG. 3 is a partial perspective view of a fully erected, sealed carton made from the blank shown in FIG. 1.
Figure 4:
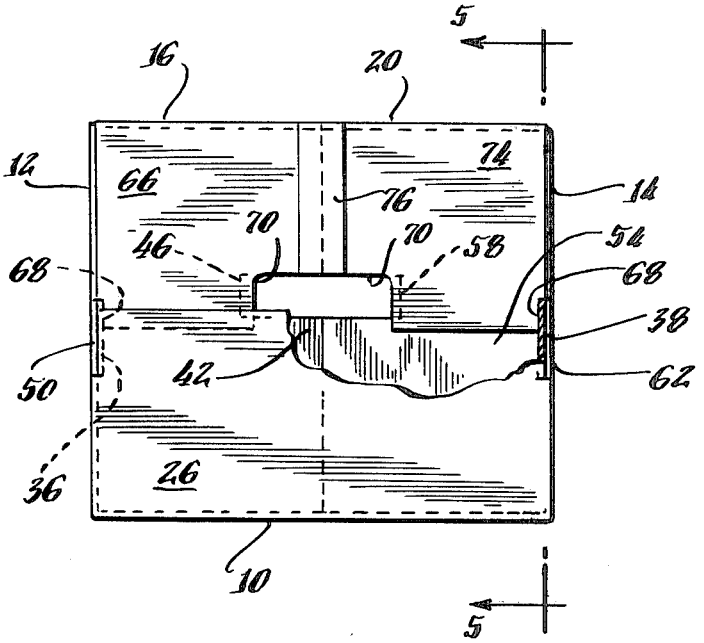
FIG. 4 is an end view of the sealed carton.

When the outer end panels have been locked into position by forcing the tab members through the narrow openings in the inner end panels, the carton can be loaded with the products or produce to shipped. To close and seal the carton, the cover flaps 66 and 74 are folded toward one another until they are perpendicular to the cover panels from which they extend. The cover panels 16 and 20 are pivoted inwardly to slip the cover flaps into place between the outer end panel 26 and the inner end panels 42 and 54, as can be seen in FIG. 3. The cover flaps overlap with the outer end panel which holds the flaps in place as a result of frictional engagement. The carton may be sealed by means of a suitable pressure-sensitie or moisture-activated strip 76 of tape. The strip of tape prevents accidental opening of the carton until the contents are to be used.

After the carton has been reopened and part of the contents removed, the carton can be reclosed to provide continued storage for the remaining contents. To reclose the carton, the cover panels 16 and 20 are independently pivoted toward the top of the container while the cover flaps are allowed to slide against the outer surface of the inner end panels. The cover panels can be released and will remain in place due to the frictional engagement between the overlapping portions of the cover flap and the inner and outer end panels.

Figure 5:
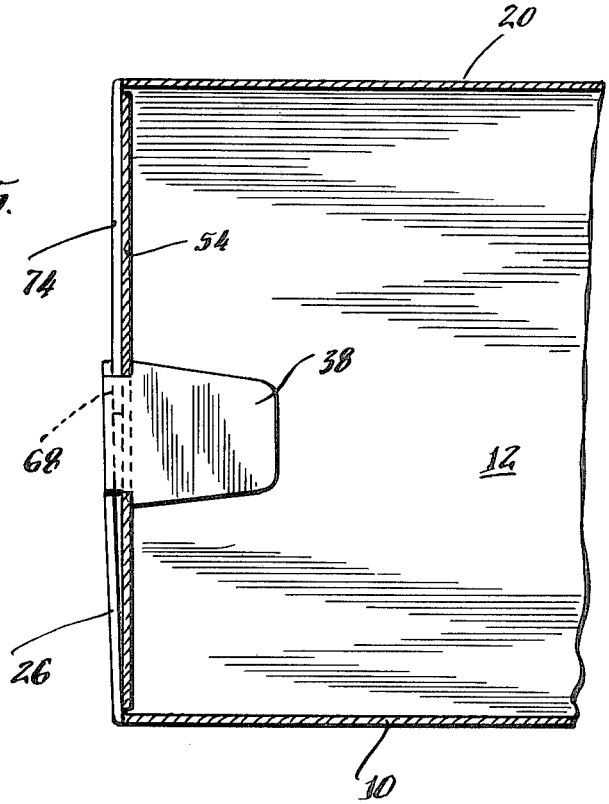
FIG. 5 is a cross-sectonal view taken along lines 5—5 of FIG. 4.

Referring to FIG. 5, it can be seen that the end walls of the carton are of double thickness. The double thickness end walls improve the stacking properties of the carton. To further enhance the stacking characteristics, the carton may be made from a corrugated containerboard in which the flutes of the material are vertical; that is, perpendicular to the upper and lower edges of the side wall panels.

It is clear that the above-described blank and carton has a number of advantageous features, some of which have already been mentioned. For example, the carton is readily reclosed after being opened to provide continued storage for unused contents. Moreover, the carton has good stacking properties. Not only can the carton be set up without the need for gluing, it can also be knocked down or collapsed between uses to facilitate storage.

While there has been described what is considered to be a preferred embodiment of the invention, variations and modifications therein will occur to those skilled in the art once they become familar with the invention. For example, the carton may be perforated or otherwise ventilated by means of openings in the side wall panels in order to allow the contents to be more readily frozen. Since this and other variations or modifications would readily occur to one skilled in the art, it is therefore intended that the appended claims shall be construed to include not only the preferred embodiment but also all such variations and modifications as fall within the true spirit and scope of the invention.

What is claimed is:

1. A self-locking, reclosable carton comprising:

a generally rectangular floor panel;

first and second generally rectangular side wall panels extending upwardly from opposite side edges of said floor panel;

an end wall assembly at each end of said carton, each said assembly including a generally rectangular outer end panel extending upwardly from an end edge of said floor panel, said outer end panel being secured in slightly spaced relation to said side wall panels, each said end wall assembly further comprising first and second inner end panels, each of which is foldably connected to an end edge of one of said side wall panels and extends at right angles thereto, each said inner end panel having a tab scored therein the fold line defining the end edge of said wall panel, said scored tab forming a narrow opening at the fold line, while said outer end panel has tab members extending from opposite side edges, said tab members being received within said narrow openings to lock the outer end panel in place in slightly spaced relation to said inner end panels wherein one of said tab members on each said outer end panel is longer than the other so as to be first to be inserted through one of the narrow openings at the end edges of the side wall panels; and a cover assembly for said carton including at least one generally rectangular cover panel connected to the upper edge of one of said side wall panels, said cover panel having end flaps extending downwardly at each end in overlapping relation to said outer end panels, said end flaps being releasably restrained by frictional engagement with said end panels to maintain a closed carton condition.

2. A blank for a self-locking, reclosable carton comprising:

a generally rectangular floor panel;

first and second generally rectangular side wall panels extending from opposite side edges of said floor panel;

first and second outer end panels extending from opposite end edges of said floor panel, each of said outer end panels including a locking means formed therein;

inner end panels extending from opposite end edges of each of said side wall panels, each of said inner end panels having a height equal to substantially one half the width of said floor panel; each said inner end panel having a tab scored therein at the boundary with said side wall panel, the locking means in said outer end panels comprising first and second tab members extending from opposite side edges adjacent the outer edge of said outer end panel, each of said tab members being generally arrow-shaped, wherein one of the tab members on an outer end panel is longer than the other; and at least one cover panel extending from an outer side edge of one of said side wall panels, each said cover panel having first and second cover flaps extending from opposite end edges thereof, the combined heights of each said cover flap and each said outer end panel being greater than the width of said side wall panels.

* * * * *

UNITED STATES PATENT AND TRADEMARK OFFICE

CERTIFICATE OF CORRECTION

PATENT NO. : 4,197,981

DATED : April 15, 1980

INVENTOR(S) : GORDON A. HAMILTON

It is certified that error appears in the above-identified patent and that said Letters Patent are hereby corrected as shown below:

In Column 1, line 27, after "boxes" insert -- lacking --.

In Colunn 2, line 32, delete "panel 14" and insert in lieu thereof -- panel 24 --;

line 44, delete "c-chaped" and insert in lieu thereof -- c-shaped --;

line 48, delete "panesl" and insert in lieu thereof -- panels --.

In Column 3, line 37, delete "sensitie" and insert in lieu thereof -- sensitive --.

Signed and Sealed this

*Thirtieth* Day of *September 1980*

[SEAL]

*Attest:*

SIDNEY A. DIAMOND

*Attesting Officer*

*Commissioner of Patents and Trademarks*